US005917166A

United States Patent [19]

Henriksson

[11] Patent Number: 5,917,166

[45] Date of Patent: Jun. 29, 1999

[54] METHOD OF WASHING SAWDUST AND ARRANGEMENT FOR CARRYING OUT THE METHOD

[75] Inventor: Jan Henriksson, Åkersberga, Sweden

[73] Assignee: Sunds Defibrator Industries AB, Sweden

[21] Appl. No.: 08/775,270

[22] Filed: Mar. 27, 1997

[30] Foreign Application Priority Data

Apr. 11, 1996 [SE] Sweden ..... 9601372

[51] Int. Cl.[6] ..... B03D 1/14

[52] U.S. Cl. ..... 209/164; 209/168; 209/173

[58] Field of Search ..... 209/162, 164, 209/168, 172, 172.5, 173, 3

[56] References Cited

U.S. PATENT DOCUMENTS

| | | | |
|---|---|---|---|
| 3,452,862 | 7/1969 | Amadon et al. | 209/2 |
| 4,378,289 | 3/1983 | Hunter | 209/722 |
| 5,011,087 | 4/1991 | Richardson et al. | 209/173 X |
| 5,084,161 | 1/1992 | Vikiö | 209/2 |
| 5,720,393 | 2/1998 | Wedel et al. | 209/17 X |

*Primary Examiner*—Tuan R. Nguyen

*Attorney, Agent, or Firm*—Lerner, David, Littenberg, Krumholz & Mentlik, LLP

[57] ABSTRACT

Methods for washing sawdust are disclosed which include providing a mixture of sawdust and water to a vessel, subjecting the mixture to a reduced pressure so that gases present in the sawdust cause expansion therein and the sawdust rises to the surface of the mixture while the contaminants descend within the vessel, and withdrawing the sawdust from the vessel, in which the sawdust is withdrawn from the vessel at a location above the point where the sawdust and water enter the vessel. Apparatus for carrying out this method is also disclosed.

12 Claims, 1 Drawing Sheet

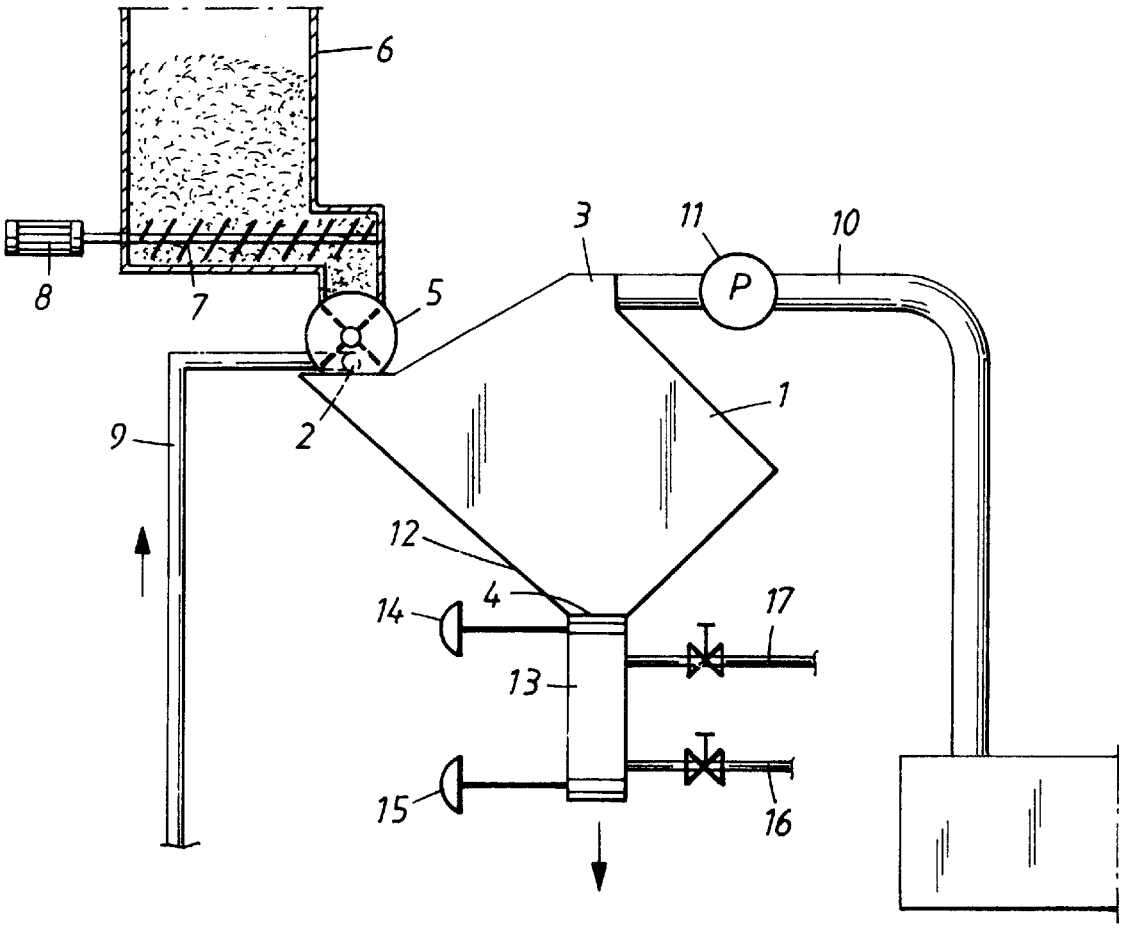
6
8
7
5
3
11
P
10
1
9
2
12
4
14
17
13
15
16

METHOD OF WASHING SAWDUST AND ARRANGEMENT FOR CARRYING OUT THE METHOD

FIELD OF THE INVENTION

The present invention relates to a method of washing sawdust and to an apparatus for carrying out the method.

BACKGROUND OF THE INVENTION

The object of the present invention is to solve the problem of washing sawdust for use in the manufacture of chipboard or particle board, and to do so in a smooth and simple manner. Methods of separating nutshells and septa from the meat of pecan nuts have been proposed, for instance as shown in U.S. Pat. No. 3,452,862, as have methods for separating light reject from paper pulp in U.S. Pat. No. 5,084,161. These methods, however, cannot be applied for the purpose of washing sawdust.

SUMMARY OF THE INVENTION

These and other objects have now been accomplished by the invention of a method for washing sawdust containing contaminants comprising providing a mixture of the sawdust and water at a first predetermined level in a vessel, subjecting the mixture to a reduced pressure whereby gases present in the sawdust cause expansion therein and the sawdust rises to the surface of the mixture and the contaminants descend within the vessel, and withdrawing the sawdust from a second predetermined level in the vessel, the second predetermined level being higher than the first predetermined level.

In accordance with one embodiment of the method of the present invention, withdrawing of the sawdust from the vessel comprises discharging the sawdust through a suction conduit, the suction conduit subjecting the mixture to the reduced pressure.

In accordance with another embodiment of the method of the present invention, the method includes removing the contaminants from the vessel at a location at the bottom thereof. In a preferred embodiment, the method includes pumping the sawdust through the suction conduit.

In accordance with the apparatus of the present invention, apparatus has been discovered for washing sawdust containing contaminants which comprises a vessel for containing a mixture of the sawdust and water, an inlet for providing the mixture to the vessel at a first predetermined level in the vessel, a suction conduit for generating a reduced pressure in the vessel whereby gases present in the sawdust cause expansion therein and the sawdust rises to the surface of the mixture and the contaminants descend within the vessel, and an outlet for withdrawing the sawdust from the vessel at a second predetermined level, the second predetermined level being higher than the first predetermined level.

In accordance with one embodiment of the apparatus of the present invention, the suction conduit is connected to the outlet.

In accordance with another embodiment of the apparatus of the present invention, the apparatus includes a transporting pump in the outlet.

In accordance with another embodiment of the apparatus of the present invention, the apparatus includes a contaminant outlet at the bottom of the vessel. In a preferred embodiment, a contaminant removal sluice is incorporated in the contaminant outlet.

In accordance with another embodiment of the apparatus of the present invention, the apparatus includes a sawdust feeder for feeding the sawdust to the inlet, and a water conduit for supplying the water to the vessel adjacent to the sawdust feeder. In a preferred embodiment, the sawdust feeder comprises a rotary vane feeder or a plug screw.

In accordance with another embodiment of the apparatus of the present invention, the apparatus includes dewatering means connected to the outlet for dewatering the washed sawdust.

BRIEF DESCRIPTION OF THE DRAWING

The present invention can be more fully appreciated with reference to the following detailed description, which, in turn, refers to the FIGURE, in which:

FIG. 1 is a side, elevational, partially schematic view of an apparatus for conducting the method according to the present invention.

DETAILED DESCRIPTION

Referring to the FIGURE, FIG. 1 illustrates a sawdust washing apparatus which includes a wash vessel 1. The vessel includes an inlet 2 for sawdust that is to be washed, an outlet 3 for washed sawdust, and a contaminant outlet 4. Mounted adjacent to the sawdust inlet 2 is a feeder 5 to which sawdust is delivered from a sawdust bin 6 by means of a screw conveyor 7 driven by a motor 8. The feeder 5 may have the form of a rotary vane feeder, a plug screw or some other appropriate feed means. A wash water conduit 9 discharges water adjacent to the feeder outlet, the water being used to wash the feeder 5 to fill the vessel 1 with water and admix sawdust therewith.

The outlet 3 for washed sawdust is located at a higher level than the inlet 2. The upper part of the wash vessel 1 is connected to a suction line 10 which functions to generate a reduced pressure or subpressure in the wash vessel. The method and apparatus of the present invention are based on the fact that the gases, inter alia air, present in the wood in the sawdust expand when the vessel containing the water/sawdust mixture is placed under a subpressure. The sawdust, which has a tendency to settle when saturated, will therewith float to the surface of the water. In the device illustrated in FIG. 1, the suction conduit 10 has been combined with the sawdust outlet, and consequently a sawdust pump 11 is provided in that conduit.

The contaminant outlet 4 is located in the funnel-shaped bottom 12 of the wash vessel 1. Sand and other contaminants will sink to the bottom of the vessel, from where they can be discharged continuously with the aid of a scrap sluice 13. Wash water conduits 16 and 17 for washing the sluice 13 are connected between the valves 14 and 15 of the sluice 13.

The inventive method and the arrangement hereof take advantage of the fact that the volume of the sawdust will increase under the influence of the generated subpressure and the sawdust consequently floats upwards, whereas the contaminants will fall to the bottom of the wash vessel.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method of washing sawdust containing contaminants comprising providing a mixture of said sawdust and water at a first predetermined level in a vessel, subjecting said mixture to a reduced pressure whereby gases present in said sawdust cause expansion therein and said sawdust rises to the surface of said mixture and said contaminants descend within said vessel, and withdrawing said sawdust from a second predetermined level in said vessel, said second predetermined level being higher than said first predetermined level.

2. The method of claim 1 wherein said withdrawing of said sawdust from said vessel comprises discharging said sawdust through a suction conduit, said suction conduit subjecting said mixture to said reduced pressure.

3. The method of claim 1 including removing said contaminants from said vessel at a location at the bottom thereof.

4. The method of claim 2 including pumping said sawdust through said suction conduit.

5. Apparatus for washing sawdust containing contaminants comprising a vessel for containing a mixture of said sawdust and water, an inlet for providing said mixture to said vessel at a first predetermined level in said vessel, a suction conduit for generating a reduced pressure in said vessel whereby gases present in said sawdust cause expansion therein and said sawdust rises to the surface of said mixture and said contaminants descend within said vessel, and an outlet for withdrawing said sawdust from said vessel at a second predetermined level, said second predetermined level being higher than said first predetermined level.

6. The apparatus of claim 5 wherein said suction conduit is connected to said outlet.

7. The apparatus of claim 5 including a transporting pump in said outlet.

8. The apparatus of claim 5 including a contaminant outlet at the bottom of said vessel.

9. The apparatus of claim 8 including a contaminant removal sluice incorporated in said contaminant outlet.

10. The apparatus of claim 5 including a sawdust feeder for feeding said sawdust to said inlet, and a water conduit for supplying said water to said vessel adjacent to said sawdust feeder.

11. The apparatus of claim 10 wherein said sawdust feeder comprises a rotary vane feeder or a plug screw.

12. The apparatus of claim 5 including dewatering means connected to said outlet for dewatering said washed sawdust.

* * * * *